US005915672A

United States Patent [19]

Dickey

[11] Patent Number: 5,915,672

[45] Date of Patent: Jun. 29, 1999

[54] COLLAPSIBLE JACK STAND AND METHOD THEREFOR

[76] Inventor: Leslie A. Dickey, 360 Springdale, Payson, Ariz. 85541

[21] Appl. No.: 08/461,631

[22] Filed: Jun. 5, 1995

[51] Int. Cl.[6] ..... B66F 3/00

[52] U.S. Cl. ..... 254/133 R; 254/134; 254/DIG. 1; 248/352

[58] Field of Search ..... 254/133, 134, 254/DIG. 1, DIG. 4; 248/352, 354.5, 188.8, 165; 411/513

[56] References Cited

U.S. PATENT DOCUMENTS

| | | | |
|---|---|---|---|
| 362,548 | 5/1887 | Smith | 411/513 |
| 639,337 | 12/1899 | Antony | 411/513 |
| 2,439,854 | 4/1948 | Lipski | 248/354.5 |
| 2,529,292 | 11/1950 | Greenfield | 254/133 R |
| 3,920,212 | 11/1975 | Westwood | 248/352 |
| 4,082,249 | 4/1978 | Valdespino et al. | 254/45 |
| 4,402,487 | 9/1983 | Donnelly | 254/DIG. 4 |
| 4,715,760 | 12/1987 | Browning | 254/134 |
| 4,736,505 | 4/1988 | Vanbeber | 254/93 H |

*Primary Examiner*—David A. Scherbel
*Assistant Examiner*—Lee Wilson
*Attorney, Agent, or Firm*—Harry M. Weiss; Jeffrey D. Moy; Harry M. Weiss & Associates, P.C.

[57] ABSTRACT

The present invention relates to a highly portable collapsible jack stand. The jack stand is comprised of a plurality of leg members. Each leg member is detachably coupled to a top guide plate which is used to support and align a telescoping rod. A ram head is coupled to the telescoping rod and is used for supporting a load. A base plate is detachably coupled to the plurality of leg members. The base plate prevents the jack stand from sinking into the ground when the jack stand is in use and under a heavy load. A low profile jack may be positioned underneath the telescoping rod for raising and lowering the telescoping rod thus raising and lowering the load on the jack stand apparatus.

18 Claims, 2 Drawing Sheets

COLLAPSIBLE JACK STAND AND METHOD THEREFOR

BACKGROUND OF THE INVENTION

1. Field of the Invention

This invention relates generally to jack stands of the type used for supporting vehicles while the vehicle is being worked on, and more specifically, to a collapsible jack stand which is highly portable and which can be disassembled after use for easy storage.

2. Background of the Invention

Jack stands are commonly used for supporting a raised load. Many individuals use jack stands for supporting a raised motor vehicle so that the individual may perform maintenance work on the vehicle.

Currently, there are numerous types of jack stands on the market. For example, U.S. Pat. No. 4,042,202 discloses a jack stand with a safety locking device. The jack stand is comprised of a first tubular member having three equally spaced apart slits at the bottom of a base to form a triangular base or footprint. A second tubular member is slid in to the first tubular member and has a support pad welded to the top of the second tubular member for supporting the vehicle. U.S. Pat. No. 4,690,361 discloses another jack stand which is comprised of a cylindrical body which is supported by a tetrahedral structure.

While current jack stands do work in supporting a raised load, there are several problems with current designs. Most jack stands are comprised of a body having a plurality of legs extending from the body for supporting the jack stand. The body of the jack stand is rather bulky and tends to take-up a lot of space. As such, current jack stands are not very portable in that the jack stand tends to take up a lot of space in the trunk of a vehicle and will not fit behind a seat of a truck. Furthermore, when the jack stand is placed on the ground and a load is placed on the jack stand, the legs on the body of the jack stand have a tendency to sink into the ground. When a mechanic goes out on the road to repair a tire on a semi-trailer or another type of motor vehicle, the mechanic has to find a piece of wood or some other type of material to place under the jack stand so that the jack stand will not sink into the asphalt road or the dirt ground.

Therefore, a need existed to provide an improved jack stand and method therefor. The improved jack stand and method therefor must be highly portable and easy to store in a motor vehicle. The improved jack stand and method therefor must also be collapsible so that it can be easily disassembled when not in use and easily reassembled when needed. The improved jack stand and method therefor must also be designed so that the jack stand will not sink into the ground when the jack stand is in use and supporting a heavy load.

SUMMARY OF THE INVENTION

In accordance with one embodiment of the present invention, it is an object of the present invention to provide an improved jack stand and method therefor.

It is another object of the present invention to provide an improved jack stand and method therefor which is highly portable and easy to store.

It is still another object of the present invention to provide an improved jack stand and method therefor which can be easily disassembled when not in use and easily reassembled when needed.

It is still another object of the present invention to provide an improved jack stand and method therefor that will not sink into the ground when the jack stand is supporting a heavy load.

BRIEF DESCRIPTION OF THE PREFERRED EMBODIMENTS

In accordance with one embodiment of the present invention, a portable collapsible jack stand apparatus is disclosed. The portable collapsible jack stand apparatus is comprised of ram head means located on a portion of the collapsible jack stand apparatus for supporting a load. A telescoping rod means having said ram head means rotatably coupled to the telescoping rod means is for supporting the ram head means and for raising and lowering the rams head means. A top guide plate means having a centrally located aperture there through is used for supporting and aligning the telescoping rod means. A plurality of leg means are detachably coupled to the top guide plate means for supporting the jack stand apparatus.

In accordance with another embodiment of the present invention, a method for providing a portable collapsible jack stand apparatus is disclosed. The method comprises the steps of: providing ram head means located on a portion of the collapsible jack stand apparatus for supporting a load; providing telescoping rod means having the ram head means rotatably coupled to the telescoping rod means for supporting the ram head means and for raising and lowering the ram head means; providing top guide plate means having a centrally located aperture there through for supporting and aligning the telescoping rod means; and providing a plurality of leg means detachably coupled to the top guide plate means for supporting the jack stand apparatus.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENTS

Figure 1:
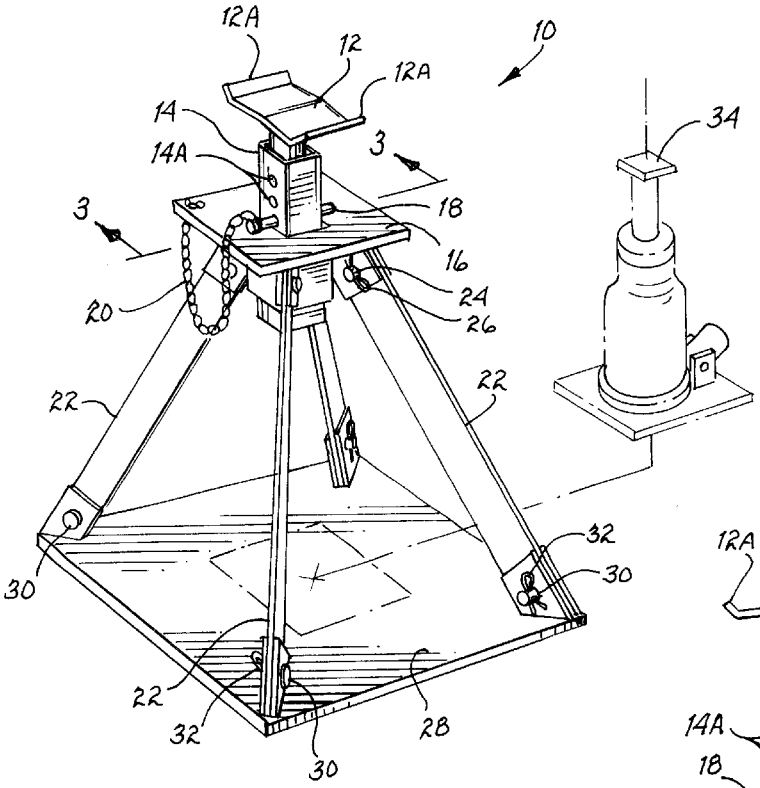
FIG. 1 is an elevated perspective view of the collapsible jack stand of the present invention.
Figure 2:
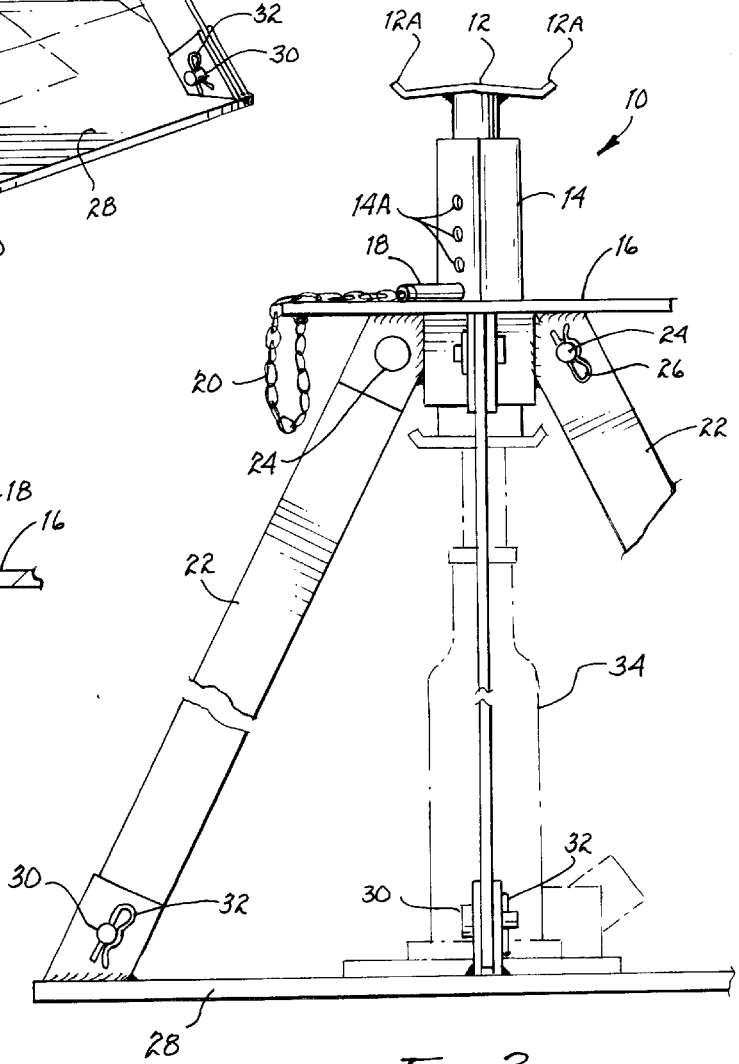
FIG. 2 is a side view of the collapsible jack stand of FIG. 1.
Figure 4:
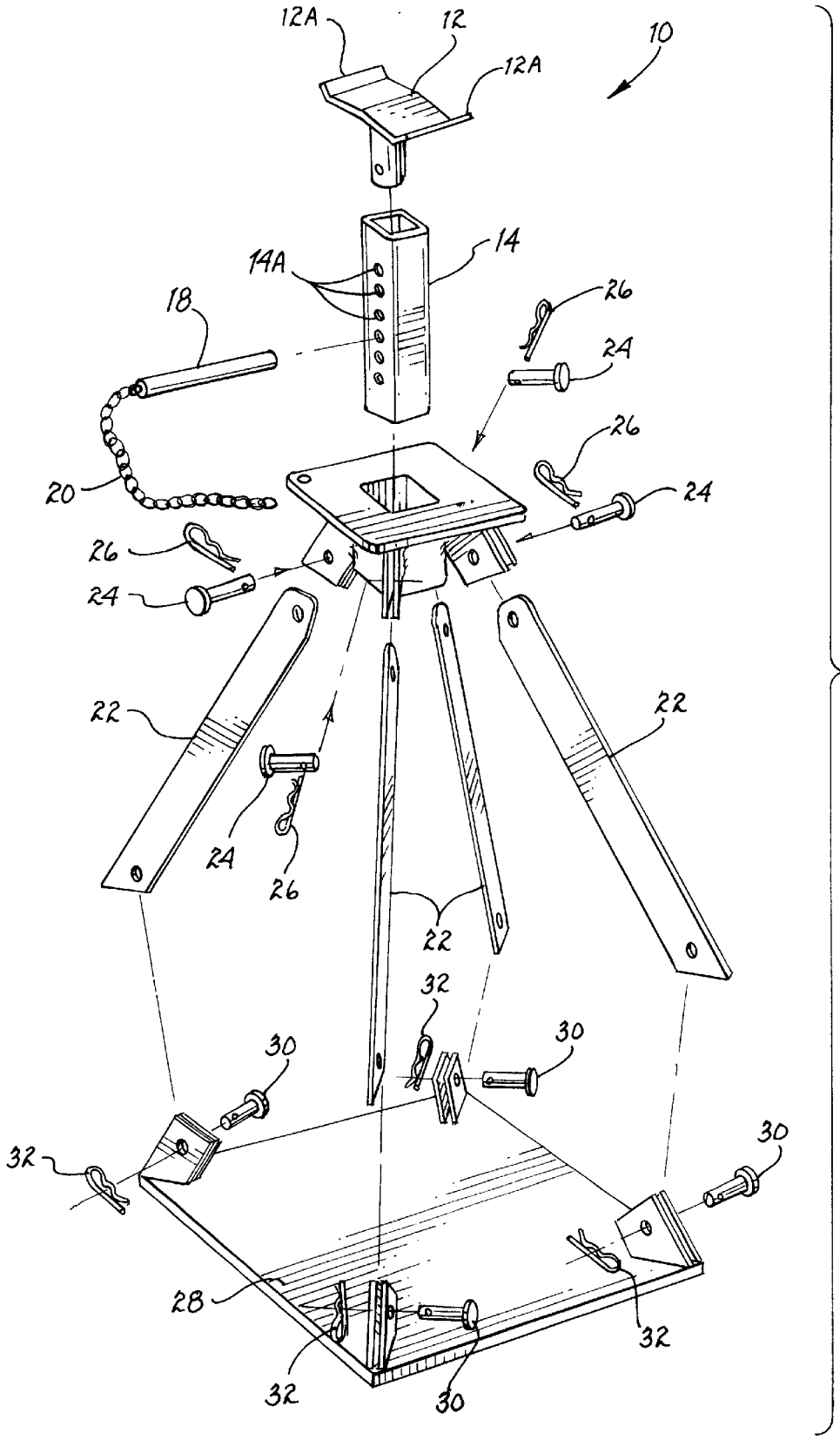
FIG. 4 is an exploded perspective view of the collapsible jack stand of FIG. 1.

Referring to FIGS. 1, 2, and 4, a highly portable collapsible jack stand 10 (hereinafter jack stand 10) is shown. The jack stand 10 is comprised of a ram head 12. The ram head 12 is the part of the jack stand 10 used for holding a raised load. In the preferred embodiment of the present invention, the ram head 12 has a pair of raised portions 12A at opposite ends of the ram head 12. The raised portions 12A are used to prevent a load from slipping off the jack stand 10.

The ram head 12 is rotatably coupled to a telescoping rod member 14. A guide plate 16 is used for aligning and supporting the telescoping rod member 14. The guide plate 16 has a centrally located aperture through which the telescoping rod member is positioned. The telescoping rod member 14 has a plurality of vertically aligned apertures 14A there through so that the telescoping rod member 14 can be positioned at a desired height.

Figure 3:
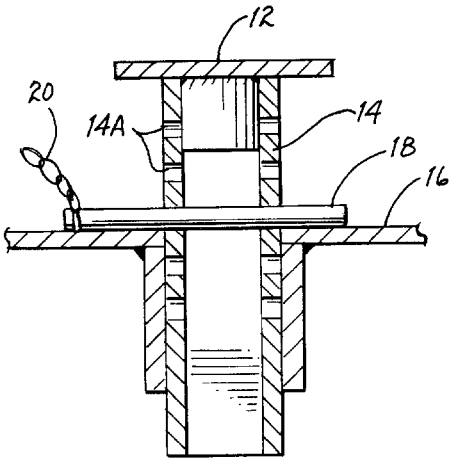
FIG. 3 is a partial cross-sectional view of the top portion of the collapsible jack stand of FIG. 1 taken along line 3—3.

Referring to FIG. 3, it can be seen that when the telescoping rod member 14 is placed at a desired height, a locking pin 18 can be extended through one of the plurality of apertures 14A in order to lock the telescoping rod member 14 at a desired height. A chain 20 is coupled to the locking pin 18 and to the top guide plate 16 for securing the locking pin 18 to the jack stand 10 so that the locking pin 18 will not be misplaced.

Referring back to FIGS. 1, 2, and 4, a plurality of legs 22 are detachably coupled to the top guide plate 16. In the preferred embodiment of the present invention, an aperture is drilled through a top portion of each of the plurality of legs 22. A corresponding aperture is drilled through a bottom portion of the top guide plate 16. When the aperture of the top portion of each leg 22 is aligned with a corresponding aperture in the bottom portion of the top guide plate 16, a removable pin 24 may be inserted through the aperture in the top guide plate 16 and through the aperture in the leg 22 to couple each of the plurality of legs 22 to the top guide plate 16. A locking ring 26 may be inserted through an aperture in the removable pin 24 to prevent the removal of the removable pin 24.

A base plate 28 is detachably coupled to a bottom portion of each of the plurality of legs 22. The base plate 28 is of sufficient size to prevent the jack stand 10 from sinking into the ground when a load is placed on the jack stand 10. In the preferred embodiment of the present invention, the base plate 28 is coupled to each of the plurality of legs 22 in the following manner. An aperture is drilled through a bottom portion of each of the plurality of legs 22. A corresponding aperture is drilled through a top portion of the base plate 28. When the aperture of the bottom portion of each leg 22 is aligned with a corresponding aperture in the top portion of the base plate 28, a second removable pin 30 may be inserted through the aperture in the base plate 28 and through the bottom aperture in the leg 22 to couple each of the plurality of legs 22 to the base plate 28. A second locking ring 32 may be inserted through an aperture in the second removable pin 30 to prevent the removal of the second removable pin 30.

Referring now specifically to FIGS. 1 and 2, a low profile jack 34 may be used with the jack stand 10. The low profile jack 34 should positioned underneath the telescoping rod member 14. When in proper position, the low profile jack 34 may be used to raise and lower the telescoping rod member 14 and thus, any load placed on the jack stand 10.

While the invention has been particularly shown and described with reference to preferred embodiments thereof, it will be understood by those skilled in the art that the foregoing and other changes in form and details may be made therein without departing from the spirit and scope of the invention.

I claim:

1. A portable collapsible jack stand apparatus comprising, in combination:

ram head means located on a portion of said collapsible jack stand apparatus for supporting a load;

telescoping rod means having said ram head means rotatably coupled to said telescoping rod means for supporting said ram head means and for raising and lowering said rams head means;

top guide plate means having a centrally located aperture therethrough for supporting and aligning said telescoping rod means;

base plate means for preventing said jack stand apparatus from sinking into ground when said jack stand apparatus is in use; and a plurality of leg means detachably coupled to said top guide plate means and to said base plate means for supporting said jack stand apparatus.

2. A collapsible jack stand apparatus in accordance with claim 1 further comprising low profile jack means positioned underneath said telescoping rod means for raising and lowering said telescoping rod means thus raising and lowering said load on said collapsible jack stand apparatus.

3. A collapsible jack stand apparatus in accordance with claim 1 further comprising:

a plurality of vertically aligned apertures therethrough said telescoping rod means; and locking pin means extending through at least one of said plurality of vertically aligned apertures for locking said telescoping rod means in a desired position.

4. A collapsible jack stand apparatus in accordance with claim 3 further comprising chain means coupled to said locking pin means and said top guide plate means for securing said locking pins means to said collapsible jack stand so said locking pin means will not be misplaced.

5. A collapsible jack stand apparatus in accordance with claim 1 further comprising removable pin means for detachably coupling each of said plurality of leg means to said top guide plate means.

6. A collapsible jack stand apparatus in accordance with claim 5 further comprising locking means coupled to each of said removable pin means for preventing removal of each of said removable pin means when said locking means is coupled to each of said removable pin means.

7. A collapsible jack stand apparatus in accordance with claim 1 further comprising second removable pin means for detachably coupling each of said plurality of leg means to said base plate means.

8. A collapsible jack stand apparatus in accordance with claim 7 further comprising second locking means coupled to each of said second removable pin means for preventing removal of each of said second removable pin means when said second locking means is coupled to each of said second removable pin means.

9. A collapsible portable jack stand apparatus comprising, in combination:

ram head means located on a portion of said collapsible jack stand apparatus for supporting a load;

telescoping rod means having said ram head means rotatably coupled to said telescoping rod means and having a plurality of vertically aligned apertures therethrough said telescoping rod means for supporting said ram head means and for raising and lowering said rams head means;

top guide plate means having a centrally located aperture therethrough for supporting and aligning said telescoping rod means;

base plate means detachably coupled to said plurality of leg means for preventing said jack stand apparatus from sinking into ground when said jack stand apparatus is in use;

a plurality of leg means detachably coupled to said top guide plate means and to said base plate means for supporting said jack stand apparatus;

locking pin means extending through at least one of said plurality of vertically aligned apertures in said telescoping rod means for locking said telescoping rod means in a desired position;

removable pin means for coupling each of said plurality of leg means to said top guide plate means and said base plate means; and locking means coupled to each of said removable pin means for preventing removal of each of said removable pin means when said locking means is coupled to each of said removable pin means.

10. A collapsible jack stand apparatus in accordance with claim 9 further comprising low profile jack means positioned on said base plate means underneath said telescoping rod means for raising and lowering said telescoping rod means thus raising and lowering said load on said collapsible jack stand apparatus.

11. A method for providing a portable collapsible jack stand apparatus comprising the steps of:

providing ram head means located on a portion of said collapsible jack stand apparatus for supporting a load;

providing telescoping rod means having said ram head means rotatably coupled to said telescoping rod means for supporting said ram head means and for raising and lowering said rams head means;

providing top guide plate means having a centrally located aperture therethrough for supporting and aligning said telescoping rod means;

providing base plate means for preventing said jack stand apparatus from sinking into ground when said jack stand apparatus is in use;

providing a plurality of leg means detachably coupled to said top guide plate means and to said base plate means for supporting said jack stand apparatus.

12. The method of claim 11 further comprising the step of providing low profile jack means positioned underneath said telescoping rod means for raising and lowering said telescoping rod means thus raising and lowering said load on said collapsible jack stand apparatus.

13. The method of claim 11 further comprising the steps of:

providing a plurality of vertically aligned apertures therethrough said telescoping rod means; and providing locking pin means extending through at least one of said plurality of vertically aligned apertures for locking said telescoping rod means in a desired position.

14. The method of claim 13 further comprising the steps of providing chain means coupled to said locking pin means and said top guide plate means for securing said locking pins means to said collapsible jack stand so said locking pin means will not be misplaced.

15. The method of claim 11 further comprising the step of providing removable pin means for detachably coupling each of said plurality of leg means to said top guide plate means.

16. The method of claim 15 further comprising the step of providing locking means coupled to each of said removable pin means for preventing removal of each of said removable pin means when said locking means is coupled to each of said removable pin means.

17. The method of claim 11 further comprising the step of providing second removable pin means for detachably coupling each of said plurality of leg means to said base plate means.

18. The method of claim 17 further comprising the step of providing second locking means coupled to each of said second removable pin means for preventing removal of each of said second removable pin means when said second locking means is coupled to each of said second removable pin means.

* * * * *